US008715104B1

(12) United States Patent
Wall, Jr. et al.

(10) Patent No.: US 8,715,104 B1
(45) Date of Patent: May 6, 2014

(54) ADJUSTABLE GOLF CLUB SHAFT AND HOSEL ASSEMBLY

(75) Inventors: Broadus Perry Wall, Jr., Carlsbad, CA (US); Homer E. Aguinaldo, Chula Vista, CA (US); Denver Holt, Carlsbad, CA (US); James A. Seluga, Carlsbad, CA (US); Scott Manwaring, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 244 days.

(21) Appl. No.: 13/436,512

(22) Filed: Mar. 30, 2012

Related U.S. Application Data

(63) Continuation-in-part of application No. 13/332,846, filed on Dec. 21, 2011, and a continuation-in-part of application No. 13/311,319, filed on Dec. 5, 2011, now Pat. No. 8,684,859.

(60) Provisional application No. 61/451,523, filed on Mar. 10, 2011, provisional application No. 61/452,521, filed on Mar. 14, 2011.

(51) Int. Cl.
*A63B 53/02* (2006.01)

(52) U.S. Cl.
USPC ..... 473/309; 473/246

(58) Field of Classification Search
USPC ..... 473/288, 307, 244–248
See application file for complete search history.

(56) References Cited

U.S. PATENT DOCUMENTS

| | | | | | |
|---|---|---|---|---|---|
| 1,601,770 | A * | 10/1926 | Reach et al. | ..... | 473/307 |
| 2,027,452 | A * | 1/1936 | Rusing | ..... | 473/246 |
| 5,257,807 | A * | 11/1993 | Baumann et al. | ..... | 473/312 |
| 6,270,425 | B1 * | 8/2001 | Dyer | ..... | 473/307 |
| 6,332,945 | B1 * | 12/2001 | Lenhof et al. | ..... | 156/293 |
| 6,368,230 | B1 * | 4/2002 | Helmstetter et al. | ..... | 473/244 |
| 6,575,843 | B2 * | 6/2003 | McCabe | ..... | 473/245 |
| 6,890,269 | B2 * | 5/2005 | Burrows | ..... | 473/307 |
| 7,887,431 | B2 * | 2/2011 | Beach et al. | ..... | 473/307 |
| 7,997,997 | B2 * | 8/2011 | Bennett et al. | ..... | 473/288 |
| 8,177,661 | B2 * | 5/2012 | Beach et al. | ..... | 473/307 |
| 2004/0063515 | A1 * | 4/2004 | Boone | ..... | 473/305 |
| 2005/0101402 | A1 * | 5/2005 | Kawakami | ..... | 473/305 |

FOREIGN PATENT DOCUMENTS

| | | | | | |
|---|---|---|---|---|---|
| JP | 09117535 | A * | 5/1997 | ..... | A63B 53/02 |
| JP | 11047318 | A * | 2/1999 | ..... | A63B 53/04 |
| JP | 2001137391 | A * | 5/2001 | ..... | A63B 53/02 |
| JP | 2006042950 | A * | 2/2006 | | |

* cited by examiner

*Primary Examiner* — Stephen L. Blau
(74) *Attorney, Agent, or Firm* — Rebecca Hanovice; Michael A. Catania; Sonia Lari

(57) ABSTRACT

An adjustable shaft and hosel assembly allows for dependent and independent adjustment of a golf club's face angle, loft angle, and lie angle. The adjustable shaft and hosel assembly comprises a shaft sleeve and a tubular adjustment piece, which may be a shim or a wheel, that encircles at least a part of the shaft sleeve and is disposed within a hosel bore.

19 Claims, 11 Drawing Sheets

ADJUSTABLE GOLF CLUB SHAFT AND HOSEL ASSEMBLY

CROSS REFERENCES TO RELATED APPLICATIONS

The present application is a continuation-in-part of U.S. patent application Ser. No. 13/332,846, filed on Dec. 21, 2011, which is a continuation-in-part of U.S. patent application Ser. No. 13/311,319, filed on Dec. 5, 2011, which claims priority to U.S. Provisional Application No. 61/451,523, filed on Mar. 3, 2011, and to U.S. Provisional Application No. 61/452,521, filed on Mar. 14, 2011, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head having an adjustable shaft and hosel assembly. More specifically, the present invention relates to a golf club shaft and hosel connection assembly that allows a user to adjust the loft, lie, and face angle of the golf club head, either dependently or independently without requiring the user to remove the shaft from the hosel completely.

2. Description of the Related Art

It is known that changing the angle of a golf club shaft with respect to the golf club head will change certain club specifications, including loft angle, lie angle, and face angle. Several types of adjustable golf clubs are currently available on the market. These models allow the user to adjust loft, lie and face angle by adjusting certain golf club components, which themselves rotate the shaft in a cone-shaped path about a reference axis.

Current adjustable golf club models include rotatable component features that are used for angle indexing and for transmitting torque forces between the club body and shaft, and vice-versa. These component features limit the number of shaft angle adjustments, however. The maximum angular range of these designs has been found to be approximately ±2.0° from the reference axis. None of the currently available adjustable golf clubs permit a 0° angle adjustment with respect to the reference axis.

The adjustable golf club models currently on the market have other drawbacks in addition to limited shaft angle adjustability. Because the shaft is fixed to the standard rotating features of these golf clubs, which operate on a fixed cone range of movement, the shaft graphics and grip reminder rotate out of orientation with the club head body when angles are adjusted. This can frustrate golfers who rely on grip reminders or asymmetric grips while using their clubs.

BRIEF SUMMARY OF THE INVENTION

The present invention relates to wood golf club heads that have angular adjustable shaft and hosel assemblies. One aspect of the present invention is an adjustable golf club head comprising a body comprising a face, a sole, and a crown, a shaft sleeve having a shaft sleeve axis and a shaft-receiving bore, a first tubular adjustment piece having non-parallel upper and lower surfaces, and a hosel having a hosel bore extending from an opening in the sole to an opening in the crown, wherein the first tubular adjustment piece encircles a section of the shaft sleeve, wherein the hosel bore receives at least a part of the shaft sleeve when that part is encircled by the first tubular adjustment piece, and wherein rotating the first tubular adjustment piece around the shaft sleeve changes the angle of the shaft sleeve, including the shaft sleeve axis, with respect to the face.

In some embodiments, the hosel may further comprise a flange proximate the crown, wherein the shaft sleeve may be inserted into the hosel bore through the opening in the sole, and wherein an upper surface of the shaft sleeve may abut a lower surface of the flange and prevent the shaft sleeve from leaving the hosel bore through the opening in the crown. The adjustable golf club head may also comprise a plug sized to fit within the opening in the sole, wherein an upper surface of the plug may abut a lower surface of the shaft sleeve and press the upper surface of the shaft sleeve against the lower surface of the flange to retain the shaft sleeve within the hosel bore.

In a further embodiment of the invention, the adjustable golf club head may comprise a screw comprising a head and a threaded extension, the plug may comprise a recess sized to receive the head of the screw and a first screw bore sized to receive the threaded extension, the opening in the sole may comprise a second screw bore sized to receive the threaded extension, and the screw may removably retain the plug within the opening in the sole. The shaft sleeve may comprise a ledge, and the upper surface of the first tubular adjustment piece may abut the ledge. The adjustable golf club head may further comprise a second tubular adjustment piece having non-parallel upper and lower surfaces encircling the shaft sleeve, the upper surface of the second tubular adjustment piece may abut the lower surface of the first tubular adjustment piece, and a lower surface of the second tubular adjustment piece may abut the upper surface of the plug. The ledge of the shaft sleeve may further comprise a first set of alignment features, the upper surface of the first tubular adjustment piece may comprise a second set of alignment features, and the first set of alignment features may mate with the second set of alignment features when the upper surface of the first tubular adjustment piece abuts the ledge of the shaft sleeve.

In some embodiments of this invention, the plug may be composed of a non-metal material selected from the group consisting of rubber, plastic, and composite. The shaft sleeve and the first tubular adjustment piece may be composed of a metal alloy material. In yet another embodiment, the hosel may comprise a side opening providing access to the hosel bore, and the first tubular adjustment piece may be rotated through the side opening. The first tubular adjustment piece may further comprise an exterior surface comprising texturing to facilitate movement of the first tubular adjustment piece within the hosel. In another embodiment, the shaft-receiving bore may comprise an axis that is coaxial with the shaft sleeve axis, the first tubular adjustment piece may provide a plurality of angular adjustments, and the shaft sleeve may not rotate around the bore axis more than 5 degrees for any of the plurality of angular adjustments.

Another aspect of the present invention is an adjustable driver comprising a body comprising a face, a sole, and a crown, a hosel comprising a hosel bore extending from an opening in the sole to an opening in the crown and a flange proximate the crown, wherein the opening in the sole comprises a first screw bore, a shaft sleeve comprising a shaft-receiving bore and a ledge portion, the ledge portion comprising upper and lower surfaces, a first tubular adjustment piece comprising non-parallel upper and lower surfaces, a plug comprising a second screw bore, a screw comprising a head and a threaded extension portion, and a shaft comprising a grip end and a tip end, wherein the shaft sleeve is inserted into the hosel bore through the opening in the sole, wherein the tip end of the shaft is secured within the shaft-receiving bore of the shaft sleeve, wherein the first tubular adjustment piece encircles at least a portion of the shaft sleeve, wherein the shaft sleeve fits within the hosel bore when it is encircled by the first tubular adjustment piece, wherein the upper surface of the ledge portion abuts the flange, wherein the upper surface of the first tubular adjustment piece abuts the lower surface of the ledge portion, wherein the plug fits within the opening in the sole such that the second screw bore lines up with the first screw bore, and wherein the threaded extension of the screw engages the first and second screw bores to retain the plug within the opening in the sole.

In some embodiments, the lower surface of the first tubular adjustment piece may abut an upper surface of the plug. The adjustable driver may further comprise a second tubular adjustment piece comprising non-parallel upper and lower surfaces encircling at least a portion of the shaft sleeve, wherein the lower surface of the first tubular adjustment piece may abut the upper surface of the second tubular adjustment piece, and wherein the lower surface of the second tubular adjustment piece may abut an upper surface of the plug, and wherein the plug may secure the first and second tubular adjustment pieces within the hosel bore. The lower surface of the ledge portion may further comprise a first set of alignment features, the upper surface of the first tubular adjustment piece may further comprise a second set of alignment features, and the first set of alignment features may mate with the second set of alignment features when the upper surface of the first tubular adjustment piece abuts the lower surface of the ledge portion.

In some embodiments of the adjustable driver, the face may be composed of a metal alloy material, the sole may be composed of a metal alloy material, and the crown may be a composed of a composite material. Some embodiments may further comprise a locking pin that may engage the plug and the hosel bore to align the plug within the opening in the sole. In some embodiments, the plug may be composed of a non-metal material selected from the group consisting of rubber, plastic, and composite. In some embodiments, each of the first and second tubular adjustment pieces may be composed of a metal alloy material.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
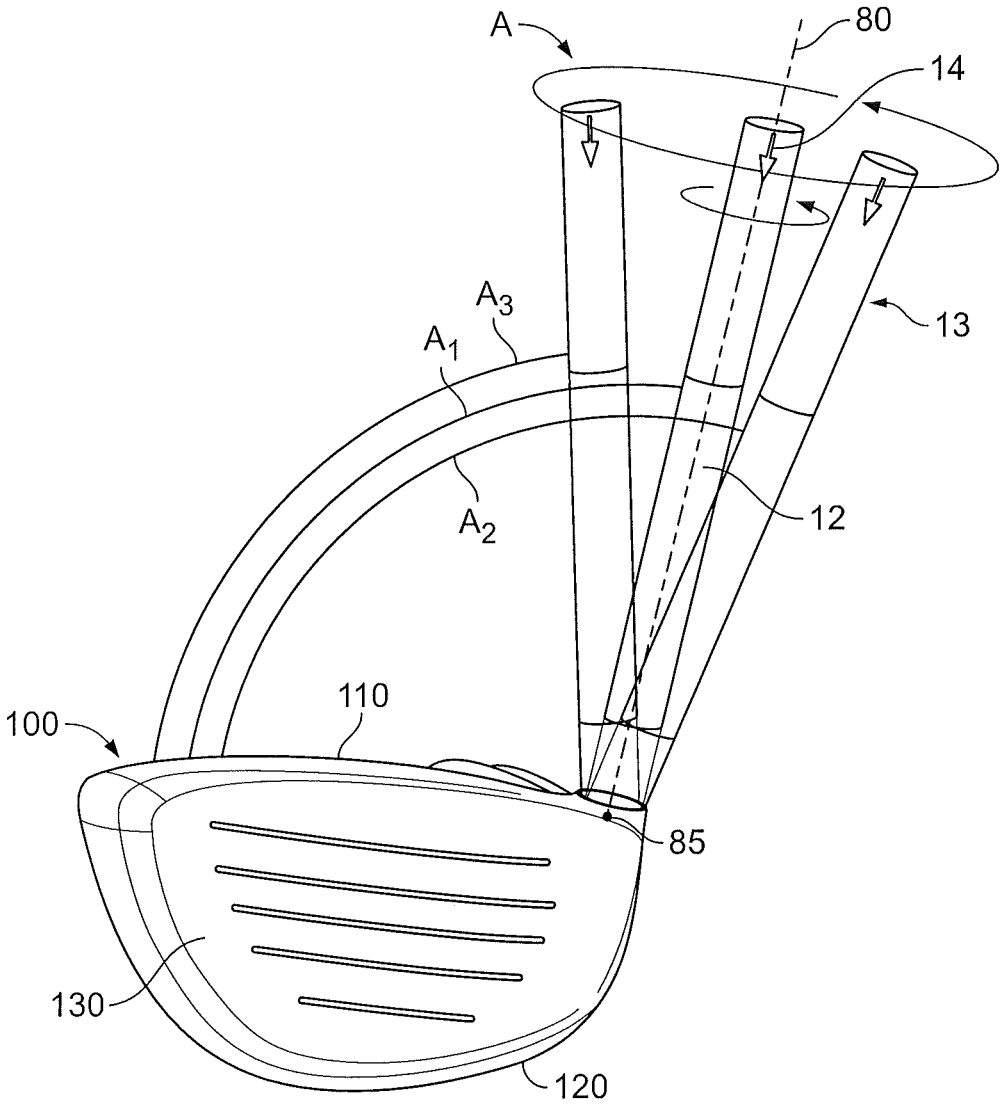
FIG. 1 is a side, perspective view of a golf club head having the adjustability features included in each embodiment of the present invention.

Angular adjustability in a golf club head is achieved through universal movement of the golf club shaft with respect to the golf club head, which almost always requires the shaft to rotate around a reference axis. As shown in FIG. 1, unlike other adjustable golf club designs currently available on the market, the present invention allows for universal angular adjustment without requiring the shaft 12, and thus the grip 13, to rotate about a reference axis 80 more than 5 degrees, if at all. Rotation around the reference axis 80 is limited or non-existent for the full range of shaft 12 angle adjustability, represented by "A" in FIG. 1, with respect to the golf club head 100 around a rotation point 85. Preferably the full range of adjustability A allows for at least 0.75 degree of hosel axis tilt in any direction. In the present invention, the torque forces between the golf club head 100 and shaft 12 are coupled and, because there is limited or no rotation about the reference axis 80, the shaft graphic and/or the grip reminder 14 remain oriented with the club head body during angular adjustment, as shown in FIG. 1 with respect to shaft-head angles $A_1$, $A_2$, and $A_3$. The full range of shaft 12 angle adjustability A in the present invention includes the 0° angle with respect to the reference axis 80.

In addition to having non-ideal adjustability features, many of the adjustable golf club heads currently available on the market are difficult to use because they require a user to make minute linear movements with respect to a pivot point to achieve the desired angular change. For example, a 1° change that is made using an adjustability feature located 1 inch from the pivot point requires the user to make a precise, 0.0174 inch linear movement. In contrast with the currently available technology, the present invention includes precise methods for setting and fixing the angular adjustments desired.

The present invention provides golfers with a structure that can be used to easily and quickly modify club specifications such as loft, lie and face angle of their golf club. This invention enables golfers to change these specifications at the practice range or golf course. The tools used to alter the club's specifications are few in number and can be carried in a pocket of the user's golf bag. Furthermore, the technical ability required to modify the club specifications with this invention is minimal and its approach is intuitive and easy to understand.

The present invention is also valuable because a golfer's swing often changes over time, which can require alterations to his clubs. A golfer may improve his game through lessons and may gain greater flexibility and strength through practice and exercise. As such, it is reasonable for a golfer to wish to change his club's face, lie, and/or loft angles to help improve his accuracy, distance, and feel as needed or desired. This applies to all types of golf clubs. In fact, though the Figures show the present invention in connection with a driver-type golf club head, the embodiments of the present invention disclosed herein may be used in connection with other wood-type golf club heads as well as with irons, hybrids, and putters.

Figure 2:
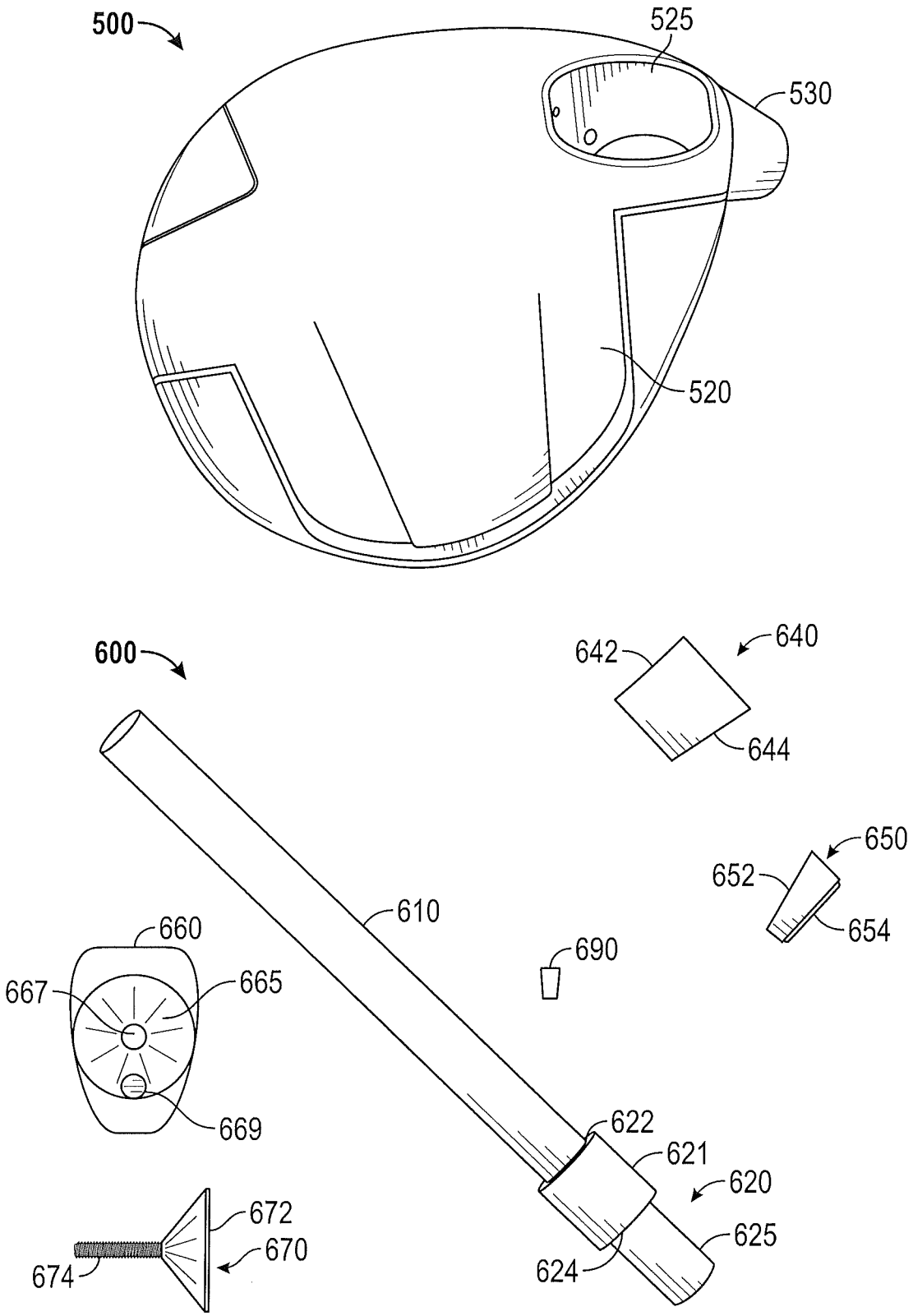
FIG. 2 is an exploded view of a preferred embodiment of the present invention.
Figure 3:
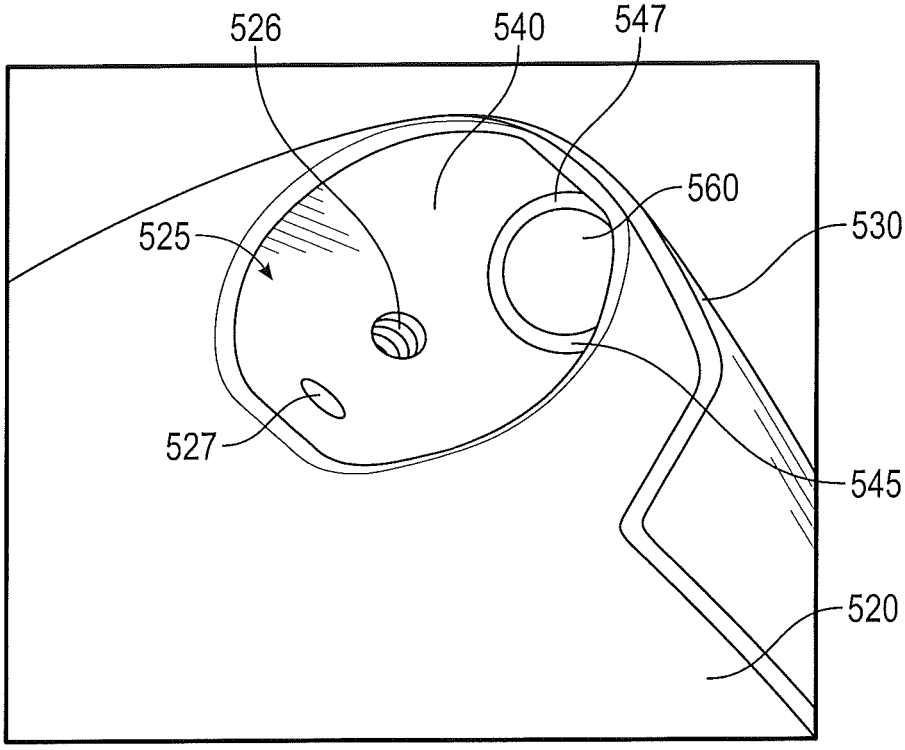
FIG. 3 is a close-up view of the hosel bore of the embodiment shown in FIG. 2.

A preferred embodiment of the present invention is shown in FIGS. 2-9. As shown in FIGS. 2 and 3, the hosel assembly 600 of this embodiment is used in connection with a golf club head 500 having a hosel 530 with a bore 540 that extends from an opening 525 in the sole 520 to a top opening 560 proximate the crown 510. The sole opening 525 provides access to the hosel bore 540 and also to a screw bore 526 and an alignment hole 527 disposed in the hosel bore 540 proximate the sole opening 525. The hosel bore 540 also includes a flange 545 proximate the top opening 560, which causes the top opening 560 to have a diameter that is smaller than the diameter of the rest of the hosel bore 540. The hosel bore 540 may also have a keyed section proximate the top opening 560 to prevent the hosel assembly from being incorrectly assembled with the head.

The hosel assembly 600 includes a shaft sleeve 620, which has a bore (not shown) sized to receive the tip end of a shaft 610, an upper portion 621 having an upper edge surface 622 and a lower edge surface 624, and a cylindrical lower portion 625 having a smaller diameter than the diameter of the upper portion 621. The upper portion 621 may be keyed to fit within the keyed section of the hosel bore 540 to ensure that the shaft sleeve 620 is inserted into the hosel bore 540 in the proper orientation and to prevent slippage or twisting during use of the club. The hosel assembly 600 also has upper and lower shims 640, 650 similar to those disclosed with respect to the embodiments disclosed in parent U.S. patent application Ser. Nos. 13/332,846 and 13/311,319, the disclosure of each of which is hereby incorporated by reference in its entirety herein, and shown in FIG. 7A of those applications. In particular, the shims 640, 650 are tubular and have non-parallel upper and lower edges 642, 644, 652, 654. The shims 640, 650 are slid over the cylindrical lower portion 625 so that each shim 640, 650 encircles the cylindrical lower portion 625.

Figure 4:
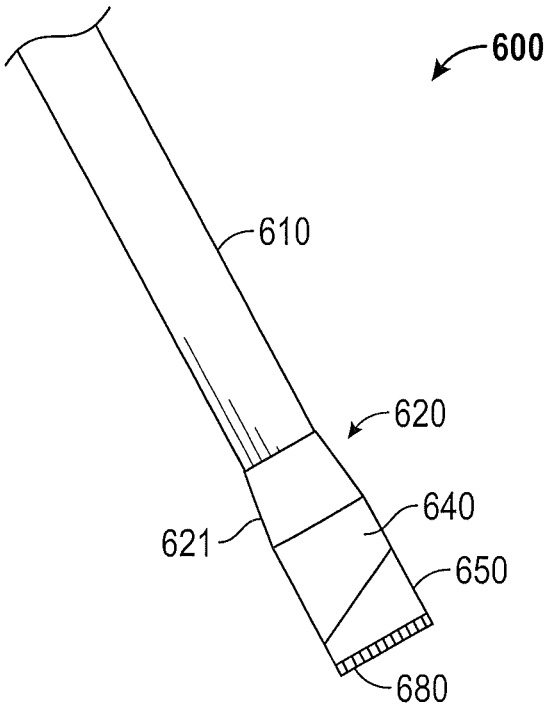
FIG. 4 is a perspective view of pieces of the embodiment shown in FIG. 2 assembled with each other.
Figure 5:
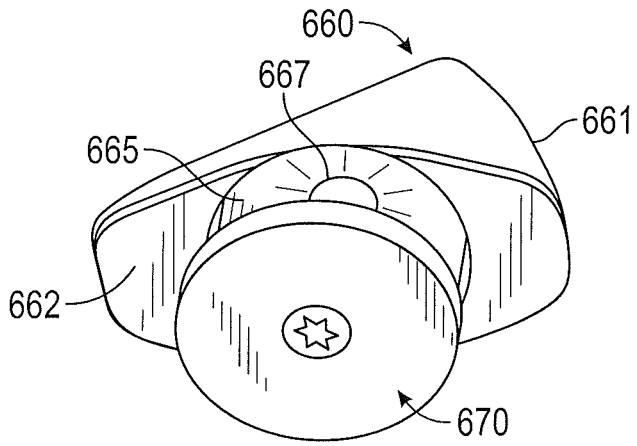
FIG. 5 is a close up view of the plug and screw assembly shown in FIG. 4.
Figure 6:
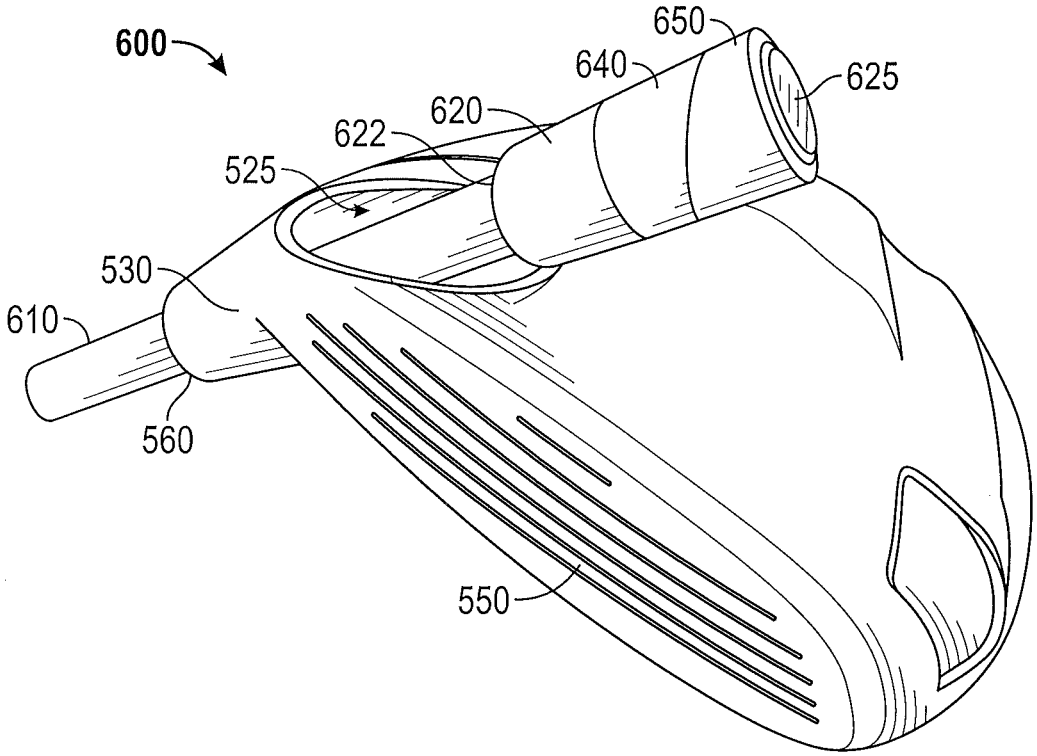
FIG. 6 is a side perspective view of the partially assembled embodiment shown in FIG. 2.

As shown in FIGS. 4 and 6, when the upper shim 640 is fully engaged with the shaft sleeve 620, its upper edge 642 abuts the lower edge surface 624 of the upper portion 621 of the shaft sleeve 620. When the lower shim 650 is fully engaged with the shaft sleeve 620, its upper edge 652 abuts the lower edge 644 of the upper shim 640. The overall angle of the shaft sleeve 620, and thus the shaft 610, with respect to the golf club face 550 can be adjusted by rotating the shims 640, 650 around the cylindrical lower portion 625 of the shaft sleeve 620 and then retaining the shaft sleeve 620 securely within the hosel 530. In a further embodiment, shown in FIG. 4, a cap 680 may be securely fixed to the lower portion 625 of the shaft sleeve 620, by any means known in the art, but preferably using a snap mechanism, to prevent the shims 640, 650 from disengaging from the lower portion 625 of the shaft sleeve 620 and to hold them in place after adjustment.

Once the shims 640, 650 have been adjusted so provide a desired shaft sleeve 620 angle, the shaft sleeve 620 is inserted into the sole opening 525 as shown in FIG. 6 such that an upper edge surface 622 of the shaft sleeve 620 abuts a lower surface 547 of the flange 545 inside the hosel bore 540. The lower surface 547 of the flange 545 preferably is concave so that the upper edge surface 622 of the shaft sleeve 620 can more easily slide along its surface when adjustments are made to its angle with respect to the golf club face 550, and to avoid unwanted friction between the shaft sleeve 620 and the hosel 530, which is discussed in detail in parent U.S. patent application Ser. Nos. 13/332,846 and 13/311,319. The upper edge surface 622 of the shaft sleeve 620 may also be concave so that it will better mate with the lower surface 547 of the flange 545 and further reduce unwanted friction. The tip end of the shaft 610 may be inserted into the shaft sleeve 620 bore after the shaft sleeve 620 is fully disposed within the hosel bore 540, or a lower piece of the shaft 610 may be disconnected from the remainder of the shaft, bonded into the shaft sleeve 620 bore, and then threaded through the hosel bore 540 as shown in FIG. 6. The shaft 610 of this embodiment cannot be easily removed from the head 500, thus decreasing the likelihood that a golfer will misplace pieces of the club or unintentionally disconnect the shaft 610 from the head 500.

Figure 7:
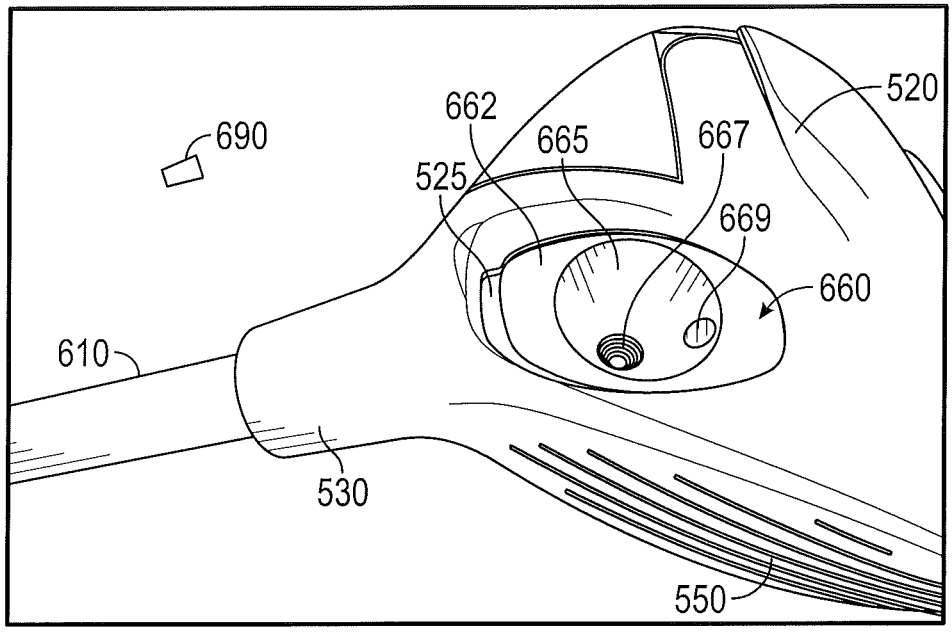
FIG. 7 is another side perspective view of the partially assembled embodiment shown in FIG. 2.
Figure 8:
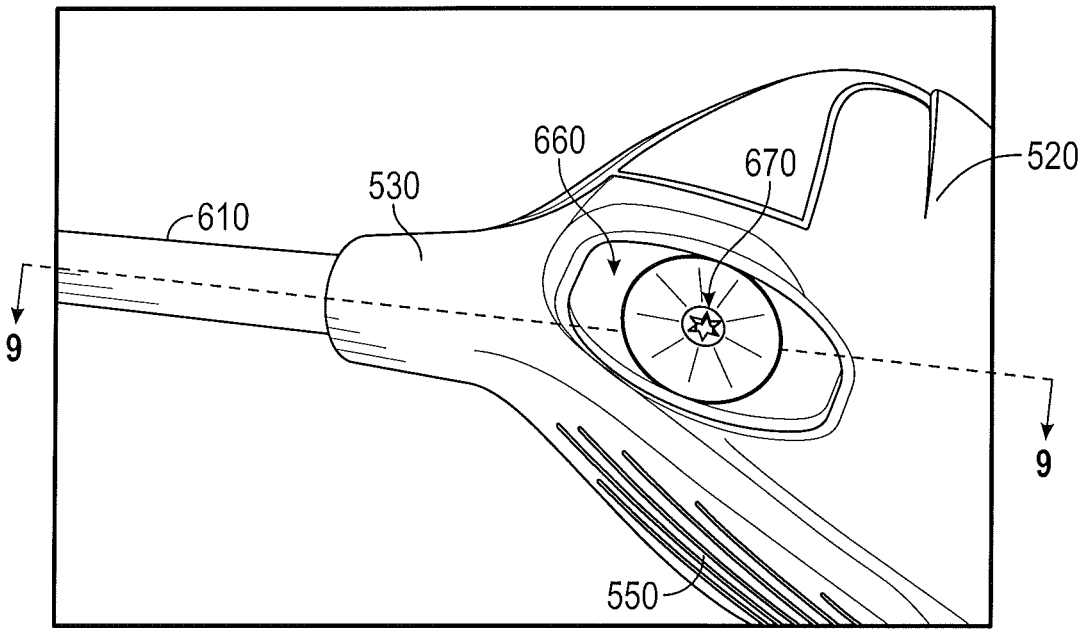
FIG. 8 is a side perspective view of the fully assembled embodiment shown in FIG. 2.
Figure 9:
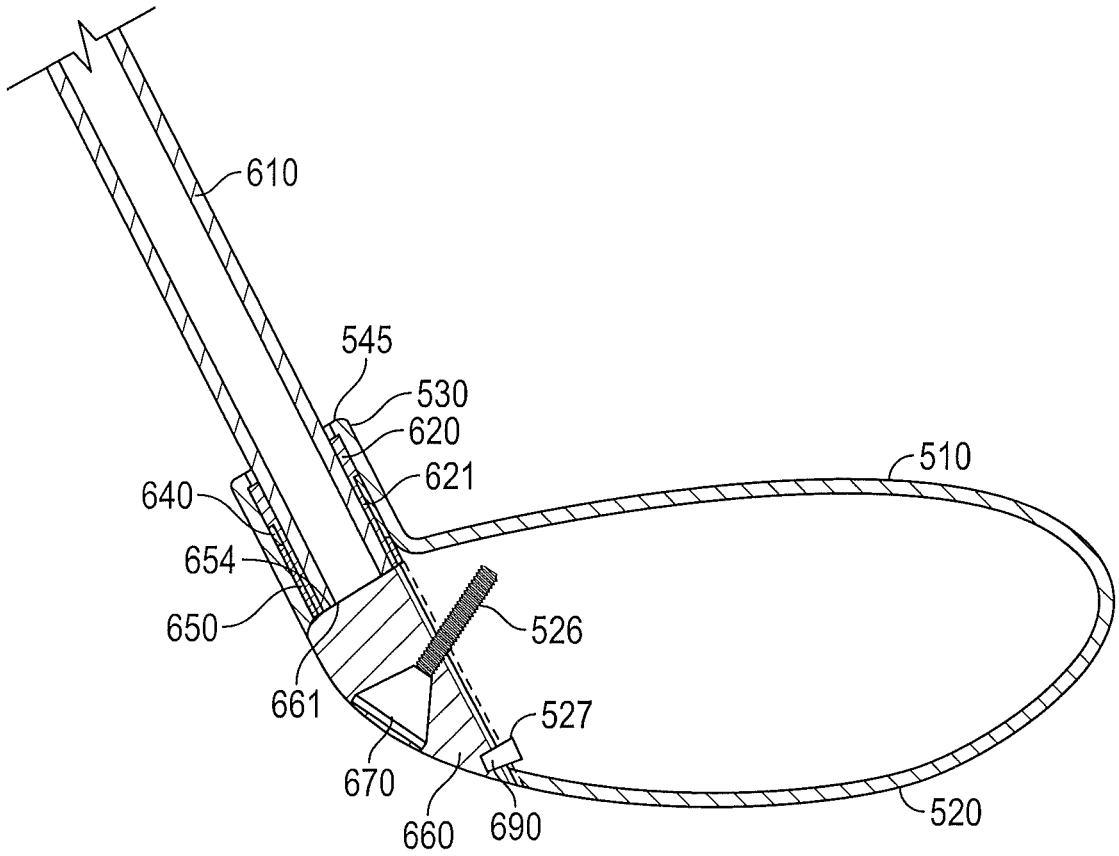
FIG. 9 is a cross-sectional view of the embodiment shown in FIG. 8 along lines 9-9.

When the shaft sleeve 620, together with the shaft 610 and shims 640, 650, is fully inserted into the hosel bore 540 such that the upper edge surface 622 rests against the flange 545, the plug 660 is inserted into the sole opening 525 to close the sole opening 525 and retain the shaft sleeve 620 and the shims 640, 650 within the hosel bore 540, as shown in FIG. 7. The plug 660, shown in greater detail in FIGS. 2 and 5, comprises an upper surface 661, a lower surface 662, and a recess 665 comprising a screw bore 667 and an alignment hole 669. The plug 660 is aligned within the sole opening 520 using a lock pin 690, which extends through the alignment hole 669 of the plug 660 and fits within the alignment hole 527 within the hosel bore 540 proximate the sole opening 620. Once the plug 660 is so aligned, it is secured within the sole opening 620 with a screw 670, shown in FIGS. 2, 8, and 9, which comprises a head 672 and a threaded extension portion 674 and can be easily inserted and removed using a simple screwdriver. The extension portion 674 extends through the screw bore 667 located in the recess 665 and engages the screw bore 526 located within the hosel bore 540 proximate the sole opening 520. As shown in FIGS. 8 and 9, when the screw 670 is fully engaged with the screw bores 667, 526 of the plug 660 and the hosel bore 540, the head 672 nests within the recess 665 and is flush with the lower surface 662 of the plug 660.

As shown in FIG. 9, when the hosel assembly 600 is fully assembled with the golf club head 500, the upper surface 661 of the plug 660 presses against the lower edge 654 of the lower shim 650, thus sandwiching the shims 640, 650 between the upper portion 621 of the shaft sleeve 620 and the plug 660, and sandwiching the shaft sleeve 620 itself between the flange 545 of the hosel bore 540 and the plug 660. The pressure created by the plug 660 retains the shims 640, 650 in the alignment selected by the user to achieve a specific angle between the shaft sleeve 620 and the face 550 of the golf club head 500.

A second embodiment of the present invention is shown in FIGS. 10-17. Like the preferred embodiment, this embodiment also utilizes a hosel assembly 800 that is located inside the hosel bore 740, but instead of shims 640, 650, the assembly 800 includes a pair of nesting adjustment wheels 830, 840, each of which has a base 832, 832 and a projection 834, 844, as shown in FIGS. 12-17. The wheels 830, 840 also preferably comprise external surfaces 835, 845 that are textured to provide a gripping surface that facilitates adjustment. The base 832 on the upper wheel 830 has a hollow portion 836 sized to receive the projection 844 of the lower wheel 840, while the projection 834 of the upper wheel 830 has a hollow portion 838 sized to receive the shaft sleeve 820. The base 842 on the lower wheel 840 has a hollow portion 846 sized to receive a part of a plug 860. As shown in FIGS. 12-17, the projections 834, 844 are not centered on the bases 832, 842, but instead are off-center so as to permit the shaft sleeve 820 to move, and thus the angle between the shaft sleeve and the face to change, when the wheels 830, 840 are adjusted.

In an alternative embodiment, these wheels 830, 840 may function in the same way as the wheels disclosed in parent U.S. application Ser. Nos. 13/311,319 and 13/332,846, specifically with reference to FIG. 12 of those applications. In this alternative embodiment, and like the embodiment shown in FIG. 12 of the parent applications referenced above and incorporated by reference in their entireties herein, each wheel has a bore that with a center point that is offset from the center point of the other wheel. The bore of the lower wheel 840 has a diameter that is larger than the diameter of the bore of the upper wheel 830, which creates a pivot surface for the shaft sleeve 820 holding the shaft 810. When the wheels 830, 840 are assembled with a shaft sleeve 820, rotating the upper wheel 830 causes the shaft sleeve 820 to move around the inner surface of the lower wheel 840 bore. The upper wheel 830 bore is sized so that it snugly receives the shaft sleeve 820 and guides the shaft sleeve 820 around the pivot surface as the wheels 830, 840 are turned.

Figure 10:
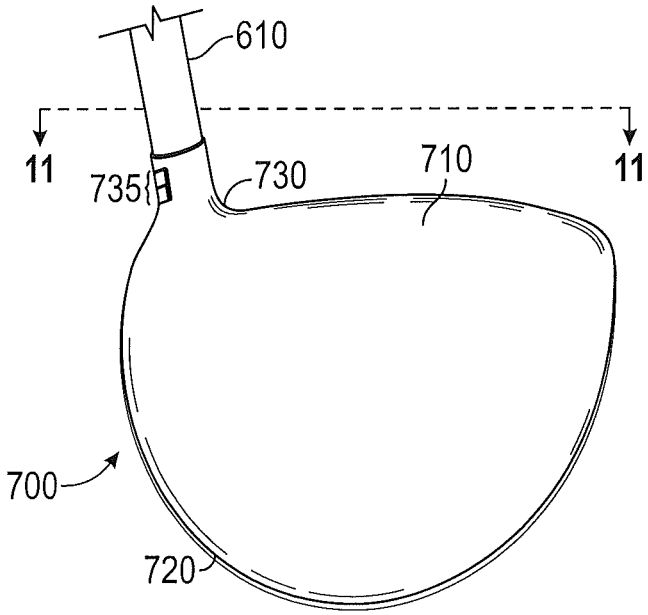
FIG. 10 is a rear perspective view of a second embodiment of the present invention.
Figure 11:
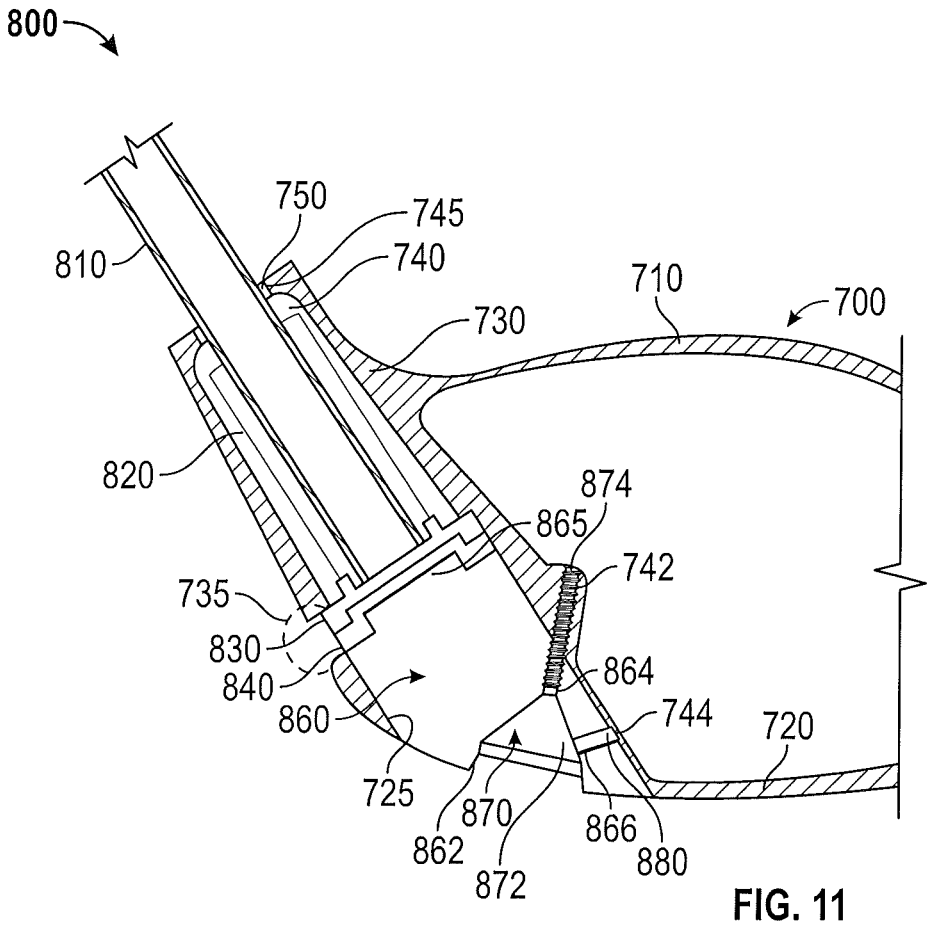
FIG. 11 is a cross-sectional view of the embodiment shown in FIG. 10 along lines 11-11.
Figure 12:
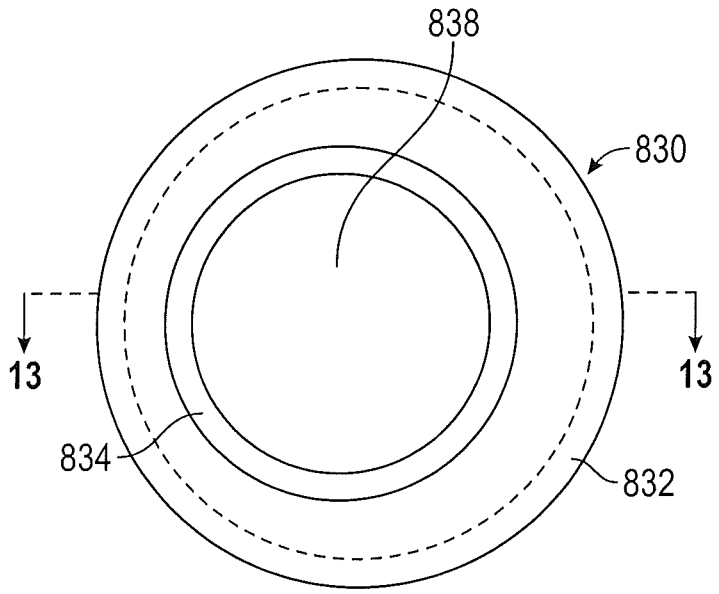
FIG. 12 is a top plan view of the first wheel of the embodiment shown in FIG. 11.
Figure 13:
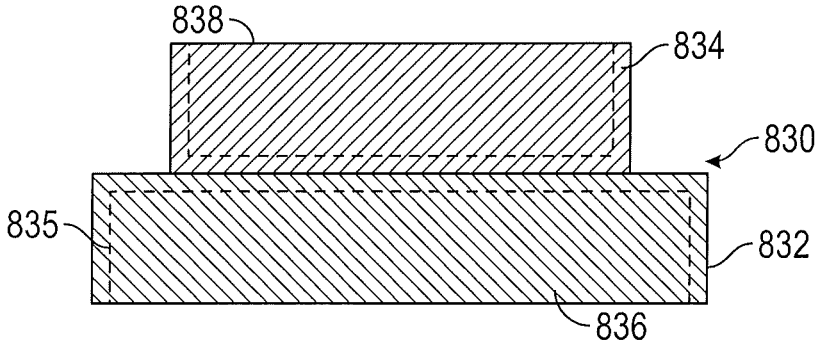
FIG. 13 is a cross-sectional view of the wheel shown in FIG. 12 along lines 13-13.
Figure 14:
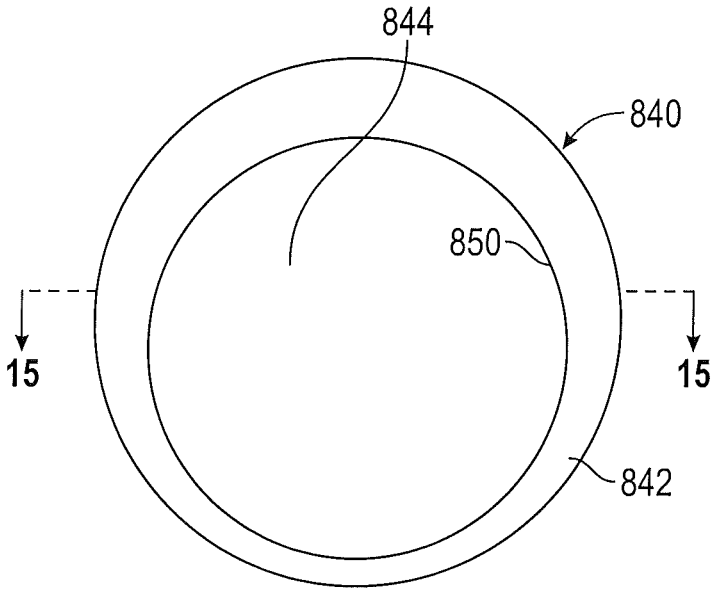
FIG. 14 is a top plan view of the second wheel of the embodiment shown in FIG. 11.
Figure 15:
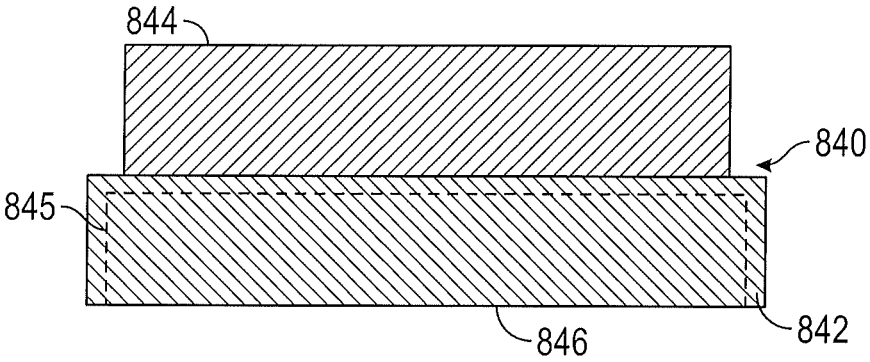
FIG. 15 is a cross-sectional view of the wheel shown in FIG. 14 along lines 15-15.

Either of these alternative wheel structures may be disposed within the hosel bore 740 of the club head 700 of the fifth embodiment, and are accessible via a window 735 in the side of the hosel 730 as shown in FIGS. 10 and 11. A user can adjust the wheels 830, 840 through the window 735 by turning the wheels 830, 840, a process that is further enabled by the textured surfaces 835, 845 of the wheels 830, 840. Like the preferred embodiment, the golf club head 700 of the second embodiment has a sole 720 with a sole opening 725 that provides access to the hosel bore 740, which extends from the sole opening 725 to an upper opening 750 proximate the crown 710. The shaft sleeve 820 is inserted into the hosel bore 740, and then the wheels 830, 840 are placed into the hosel bore so that the shaft sleeve 820 is received in the hollow portion 838 of the upper wheel's 830 projection 834, or, in the alternative wheel structure, through the wheels' 830, 840 bores. The wheels 830, 840 can then be adjusted by a golfer to achieve a desired shaft sleeve 820 angle with respect to the golf club face (not shown).

Figure 16:
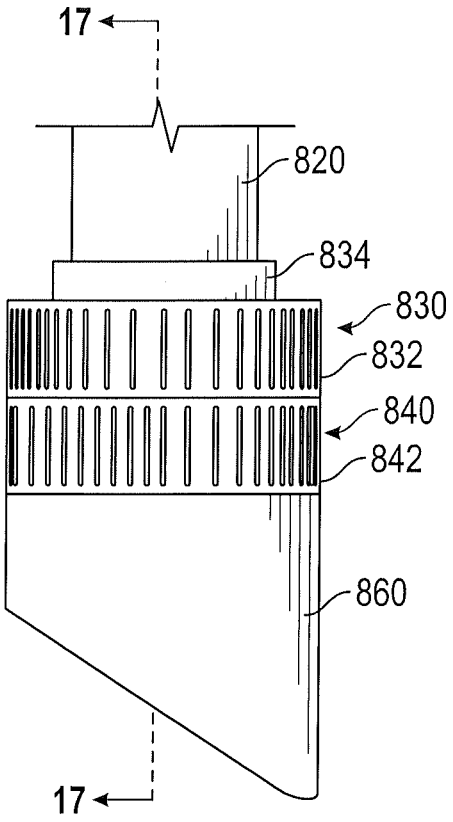
FIG. 16 is a side plan view of the wheels shown in FIG. 11 engaged with a plug and a shaft sleeve.
Figure 17:
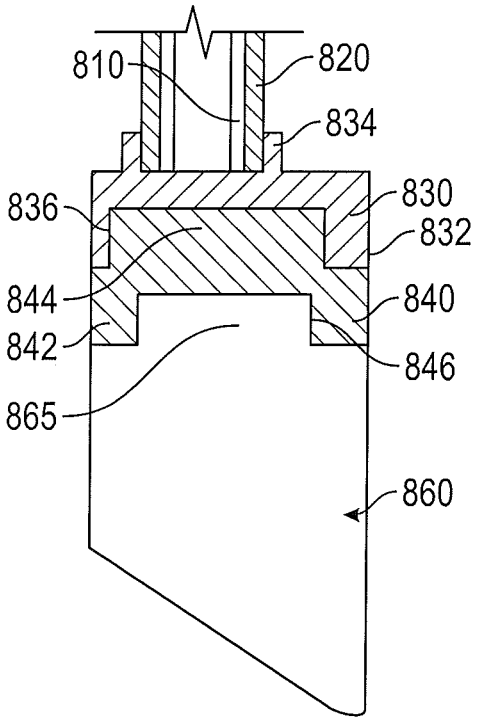
FIG. 17 is a cross-sectional view of the embodiment shown in FIG. 16 along lines 17-17.

Once the golfer has adjusted the wheels 830, 840, a plug 860 having a projection 865 is inserted into the hosel bore 740 through the sole opening 725. As shown in FIGS. 16 and 17, and with reference to the first wheel structure embodiment shown in FIGS. 12-15 herein, when the plug 860 is fully engaged with the club head 700, the projection 865 nests within the hollow portion 846 of the lower wheel 840 base 842 and presses tightly against the wheels 830, 840, securing them in a position selected by a golfer and pressing the hosel sleeve 820 against the flange 745 located near the upper opening 750 of the hosel bore 740. The pressure exerted by the plug 860 prevents the wheels 830, 840 and the shaft sleeve 820 from moving around inside the hosel bore 740 during use.

As shown in FIG. 11, the plug 860 is held in place in the sole opening 725 and hosel bore 740 with a screw 870 having a head 872 and a threaded extension portion 874. The plug 860 has a recess 862 sized to receive the head 872 of the screw 870 and a screw bore 864 sized to receive the extension portion 874 which, like in the fourth embodiment, engages with a screw bore 742 within the hosel bore 740 to secure the plug 860 to the golf club head 700. The plug 860 may be aligned within the hosel opening 725 using a lock pin 880, which is inserted through an alignment hole 866 in the plug 860 and engages with an alignment hole 744 in the hosel bore at the sole opening 720.

Figure 18A:
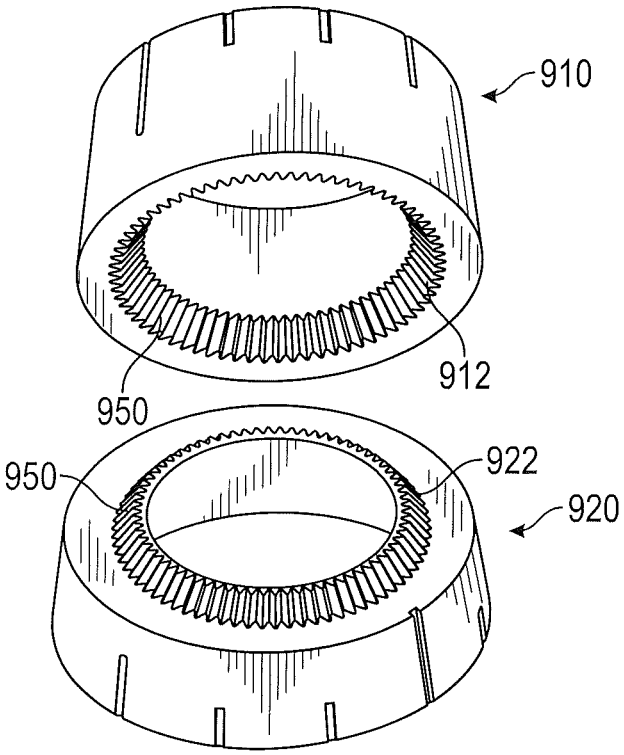
FIGS. 18A and 18B are side perspective views of shims having groove and ridge features.
Figure 19:
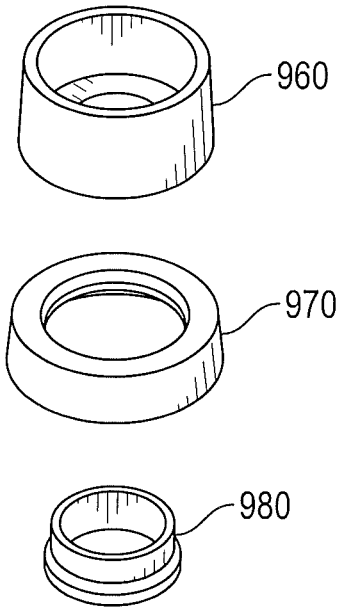
FIG. 19 is an exploded view of shims and a connector to hold them together.
Figure 18B:
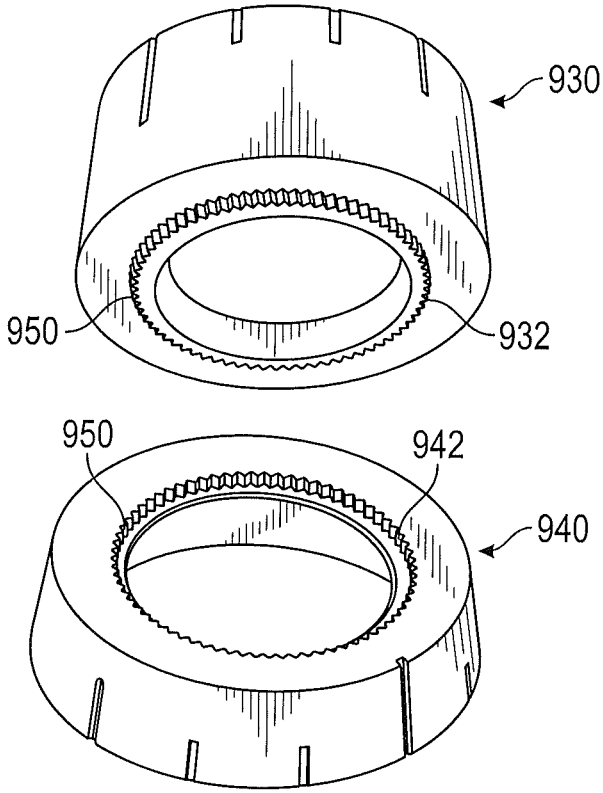

Each of the shim and wheel embodiments disclosed herein may include alignment features so that the shims or wheels more securely lock in place when they are adjusted by a golfer, which prevents slippage or twisting during use of the club. For example, the shims and wheels may include locating pins, and sockets to receive said pins, as shown in U.S. Pat. No. 2,027,452 to Rusing, the relevant disclosure of which is incorporated by reference in its entirety herein. Another option is grooves and ridges, as shown in combination with exemplary shims 910, 920, 930, 940 in FIGS. 18A and 18B. This groove and ridge pattern 950 may be disposed on nesting projections 922, 932 and recesses 912, 942 on the shims or wheels, as shown in FIGS. 18A and 18B, or they may be disposed on flush surfaces, such as those on the shims shown in FIGS. 2, 4, 6, and 9 and the wheels shown in FIGS. 11-13. Yet another option is the use of a bushing 980 that engages with both shims 960, 970 or wheels and keeps them from separating during use of the club, as shown in FIG. 19.

This embodiments disclosed herein provide many benefits when compared with other adjustable hosel assemblies. For example, instead of locating the shims 640, 650 or wheels 830, 840 of the assembly, and thus the rotation point of the shaft sleeve 620, 820, and shaft 610, 810 above or at the uppermost point of the hosel 530, 730 like in most commercial embodiments, in the embodiments of the hosel assembly 600, 800 disclosed herein, the point of rotation is moved inside the hosel 530, 730 by locating the shims 640, 650 or wheels 830, 840 inside the hosel bore 540, 740 which may have a larger average diameter than the hosel bores of other embodiments. This provides for greater overall stability of the hosel assembly 600, 800.

The configuration of the preferred embodiment also allows the golf club head 500, 700 to have a lower overall center of gravity because the weights of the various pieces of the assembly 600, 800 are moved inside the hosel 530, 730 instead of being located above the hosel 530, 730. Another feature that distinguishes the preferred embodiment from other adjustable hosel assemblies currently on the market is the insertion of the shaft sleeve 620, 820, and thus the shaft 610, 810, into the hosel 530, 730 from an opening in the sole 520, 720 of the golf club head 500, 700 instead of through an upper opening in the hosel 530, 730. The shaft sleeve 620, 820 is retained within the hosel with the plug 660, 860, which covers the opening in the sole 520, 720 and thus removes unwanted keel points and turf interaction that can be created by an opening in the sole 520, 720. As such, a golf club head 500, 700 having this assembly has better overall aerodynamics than golf club heads having openings in the sole and hosel adjustment assemblies located above the hosel.

The embodiments of the adjustable shaft and hosel assembly 10 described herein are also beneficial because they allow for universal angular adjustment. Preferably, for each of the embodiments, the angular adjustment range is a minimum of 0° to >2° from the reference axis 80. The assembly 10 of the present invention allows for torque forces to be transmitted between the body and the shaft, and visa-versa. The assembly 10 of the present invention also prevents shaft graphics and grip reminders on a golf club shaft from rotating out of orientation from the club head.

The embodiments disclosed herein may be made of any number of materials, including those material compositions disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein. Furthermore, the shims 640, 650, 910, 920, 930, 940, 960, 970 and wheels 830, 840 may be composed of lightweight materials, such as plastic, composite, aluminum, titanium alloy, and/or other such materials. The plugs 660, 860 disclosed herein also may be made of lightweight materials, preferably non-metal materials such as plastics or rubbers.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. An adjustable golf club head comprising:

a body comprising a face, a sole, and a crown;

a shaft sleeve having a shaft sleeve axis and a shaft-receiving bore;

a first tubular adjustment piece having non-parallel upper and lower surfaces; and a hosel having a hosel bore extending from an opening in the sole to an opening in the crown, wherein the hosel bore comprises a flange proximate the crown, wherein the first tubular adjustment piece encircles a section of the shaft sleeve, wherein the shaft sleeve is inserted into the hosel bore through the opening in the sole, wherein the hosel bore receives at least a part of the shaft sleeve when that part is encircled by the first tubular adjustment piece, wherein an upper surface of the shaft sleeve abuts a lower surface of the flange and prevents the shaft sleeve from leaving the hosel bore through the opening in the crown, and wherein rotating the first tubular adjustment piece around the shaft sleeve changes the angle of the shaft sleeve with respect to the face.

2. The adjustable golf club head of claim 1, further comprising a plug sized to fit within the opening in the sole, wherein an upper surface of the plug abuts a lower surface of the shaft sleeve and presses the upper surface of the shaft sleeve against the lower surface of the flange to retain the shaft sleeve within the hosel bore.

3. The adjustable golf club head of claim 2, further comprising a screw comprising a head and a threaded extension, wherein the plug comprises a recess sized to receive the head of the screw and a first screw bore sized to receive the threaded extension, wherein the opening in the sole comprises a second screw bore sized to receive the threaded extension, and wherein the screw removably retains the plug within the opening in the sole.

4. The adjustable golf club head of claim 2, wherein the shaft sleeve comprises a ledge, and wherein the upper surface of the first tubular adjustment piece abuts the ledge.

5. The adjustable golf club head of claim 4, further comprising a second tubular adjustment piece having non-parallel upper and lower surfaces encircling the shaft sleeve, wherein the upper surface of the second tubular adjustment piece abuts the lower surface of the first tubular adjustment piece, and wherein a lower surface of the second tubular adjustment piece abuts the upper surface of the plug.

6. The adjustable golf club head of claim 4, wherein the ledge of the shaft sleeve comprises a first set of alignment features, and wherein the upper surface of the first tubular adjustment piece comprises a second set of alignment features, and wherein the first set of alignment features mates with the second set of alignment features when the upper surface of the first tubular adjustment piece abuts the ledge of the shaft sleeve.

7. The adjustable golf club head of claim 2, wherein the plug is composed of a non-metal material selected from the group consisting of rubber, plastic, and composite.

8. The adjustable golf club head of claim 1, wherein each of the shaft sleeve and the first tubular adjustment piece is composed of a metal alloy material.

9. The adjustable golf club head of claim 1, wherein the hosel comprises a side opening providing access to the hosel bore, and wherein the first tubular adjustment piece can be rotated through the side opening.

10. The adjustable golf club head of claim 9, wherein the first tubular adjustment piece comprises an exterior surface, and wherein the exterior surface comprises texturing.

11. The adjustable golf club head of claim 1, wherein the shaft-receiving bore comprises an axis that is coaxial with the shaft sleeve axis, wherein the first tubular adjustment piece provides a plurality of angular adjustments, and wherein the shaft sleeve does not rotate around the bore axis more than 5 degrees for any of the plurality of angular adjustments.

12. An adjustable driver comprising:

a body comprising a face, a sole, and a crown;

a hosel comprising a hosel bore extending from an opening in the sole to an opening in the crown and a flange proximate the crown, wherein the opening in the sole comprises a first screw bore;

a shaft sleeve comprising a shaft-receiving bore and a ledge portion, the ledge portion comprising upper and lower surfaces;

a first tubular adjustment piece comprising non-parallel upper and lower surfaces;

a plug comprising a second screw bore;

a screw comprising a head and a threaded extension portion; and a shaft comprising a grip end and a tip end, wherein the shaft sleeve is inserted into the hosel bore through the opening in the sole, wherein the tip end of the shaft is secured within the shaft-receiving bore of the shaft sleeve, wherein the first tubular adjustment piece encircles at least a portion of the shaft sleeve, wherein the shaft sleeve fits within the lose bore when it is encircled by the first tubular adjustment piece, wherein the upper surface of the ledge portion abuts the flange, wherein the upper surface of the first tubular adjustment piece abuts the lower surface of the ledge portion, wherein the plug fits within the opening in the sole such that the second screw bore lines up with the first screw bore, and wherein the threaded extension of the screw engages the first and second screw bores to retain the plug within the opening in the sole.

13. The adjustable driver of claim 12, wherein the lower surface of the first tubular adjustment piece abuts an upper surface of the plug.

14. The adjustable driver of claim 12, further comprising a second tubular adjustment piece comprising non-parallel upper and lower surfaces encircling at least a portion of the shaft sleeve, wherein the lower surface of the first tubular adjustment piece abuts the upper surface of the second tubular adjustment piece, and wherein the lower surface of the second tubular adjustment piece abuts an upper surface of the plug, and wherein the plug secures the first and second tubular adjustment pieces within the hosel bore.

15. The adjustable driver of claim 13, wherein the lower surface of the ledge portion comprises a first set of alignment features, wherein the upper surface of the first tubular adjustment piece comprises a second set of alignment features, and wherein the first set of alignment features mates with the second set of alignment features when the upper surface of the first tubular adjustment piece abuts the lower surface of the ledge portion.

16. The adjustable driver of claim 14, wherein each of the first and second tubular adjustment pieces is composed of a metal alloy material.

17. The adjustable driver of claim 12, wherein the face is composed of a metal alloy material, the sole is composed of a metal alloy material, and the crown is a composed of a composite material.

18. The adjustable driver of claim 12, further comprising a locking pin, wherein the locking pin engages the plug and the hosel bore to align the plug within the opening in the sole.

19. The adjustable river of claim 12, wherein the plug is composed of a non-metal material selected from the group consisting of rubber, plastic, and composite.

* * * * *